United States Patent [19]

Chirabandalsuk

[11] Patent Number: 4,956,929

[45] Date of Patent: Sep. 18, 1990

[54] ADJUSTABLE MULTI-PIECE IRONING BOARD

[76] Inventor: Supon Chirabandalsuk, 6300 Ranchester #226A, Houston, Tex. 77036

[21] Appl. No.: 337,934

[22] Filed: Apr. 14, 1989

[51] Int. Cl.[5] ..... D06F 71/02

[52] U.S. Cl. ..... 38/136; 38/103; 108/6; 403/97

[58] Field of Search ..... 108/6, 62, 90, 94, 112, 108/114; 211/144, 129; 38/64, 135, 136, 139, 104, 112, 21, 30, 103; 403/97, 106, 146; 112/260

[56] References Cited

U.S. PATENT DOCUMENTS

| | | | |
|---|---|---|---|
| 2,647,333 | 8/1953 | Olshefski | 38/139 |
| 3,148,639 | 9/1964 | Nadal et al. | 108/112 |
| 4,543,739 | 10/1985 | Zerhoch et al. | 38/103 |
| 4,550,906 | 11/1985 | Im | 403/97 |
| 4,689,905 | 9/1987 | Vartan | 38/136 X |

FOREIGN PATENT DOCUMENTS

| | | | |
|---|---|---|---|
| 0270827 | 6/1988 | European Pat. Off. | 38/103 |
| 591594 | 5/1975 | Switzerland | 38/139 |

*Primary Examiner*—Andrew M. Falik
*Attorney, Agent, or Firm*—J. Clark Martin

[57] ABSTRACT

A pivotally adjustable ironing board including a supporting frame and first and second ironing tables which rotate separately about separate portions of a substantially horizontally disposed portion of the supporting frame. The first ironing table includes two major working surfaces arranged parallel one with the other; the second ironing table includes two major working surfaces arranged in non-parallel, non-coplanar fashion one with the other. The second ironing table includes a profiled edge portion at one end which edge is arranged to accommodate a garment and to facilitate pressing of that garment. Each ironing table employs a separate spring biased locking mechanism each of which is used to secure its respective ironing table at least generally horizontally in a position for use. The supporting frame is adjustable and includes telescoping members and a securement device which device secures the telescoping members with respect of one to the other, to establish a desired height for the ironing surfaces. In addition, the frame employs at least one stabilizing cross foot. Lastly, the second ironing table may be inclined to facilitate locking the second table in a selected position after rotation about the horizontally positioned portion of the frame.

27 Claims, 4 Drawing Sheets

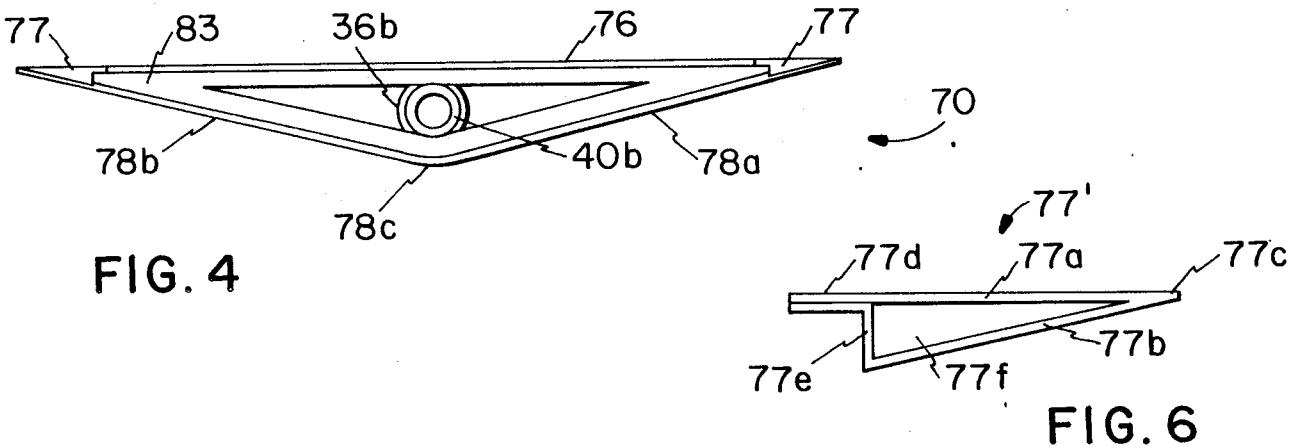
FIG. 4
FIG. 6
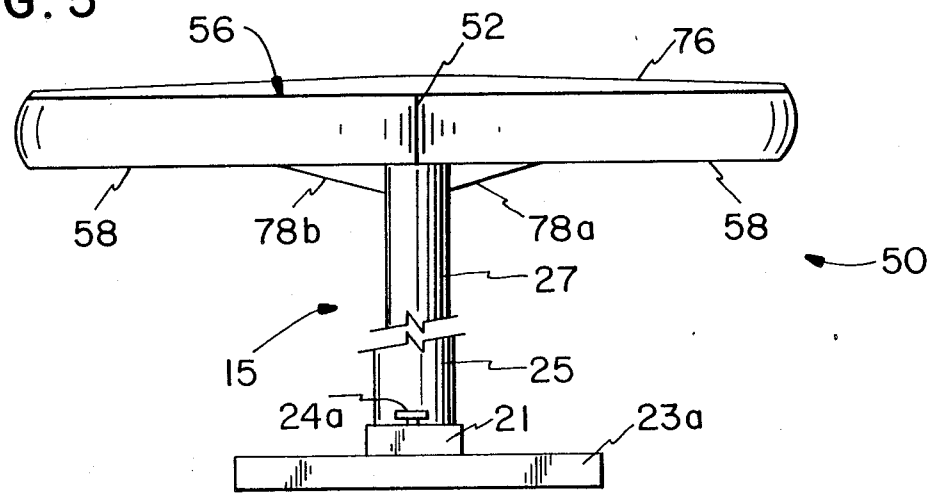
FIG. 5

ADJUSTABLE MULTI-PIECE IRONING BOARD

FIELD OF INVENTION

This invention pertains to an adjustable ironing board having a plurality of ironing tables each table including supporting means which rotate to allow both for deployment of said ironing tables and for storage of the ironing board, and more particularly to an ironing board having a profiled ironing surface carried by at least one of the ironing tables.

BACKGROUND OF THE INVENTION

Ironing boards have been used for many years and include the common household ironing board which utilizes a single ironing table having a single working surface which ironing table generally is supported by a folding frame of longitudinally intercrossing legs. Ironing boards also include the wall mounted folding ironing board such as disclosed by Wilson et al. in U.S. Letters Pat. No. 4,480,556 issued Nov. 6, 1984. Unfortunately, many of these types of ironing boards have limited use or otherwise have suffered disadvantages. Ironing boards having longitudinally intercrossing legs, for example, may lack rigidity in their use position, making them somewhat unstable especially if heavy pressure is applied during ironing. Moreover, ironing boards of this type generally are not designed to allow for rotation of a part of the working surface of the ironing board about a longitudinal axis of a substantially horizontally disposed rod portion of the frame. Likewise, wall mounted folding ironing boards are not designed to be moved from location to location within a room, and are not designed for easy transport from one room to another. In addition, both wall mounted folding ironing boards and common household ironing boards lack or are extremely limited in the amount of adjustment that can be provided, both in terms of height and in terms of rotation. Lastly, common household ironing boards generally do not provide a plurality of separate ironing tables having distinct working surfaces and do not allow for certain of those working surfaces to be selectively changed through rotation of certain of the ironing tables.

These and other problems associated with the prior art ironing boards are overcome by the present invention.

SUMMARY OF THE INVENTION

The present invention provides an improved ironing board which includes a plurality of ironing tables each table providing a stable rigid working surface in the use position, and which allows convenient rotation of each of the ironing tables to provide a selected working surface, e.g., a profiled surface. In addition, the present invention provides an adjustable supporting frame structure to aid in compact storage of the ironing board.

The ironing board of the present invention consists of a plurality of ironing tables each carried by at least one supporting member on each ironing table mounted for pivotal rotation about a substantially horizontally positioned portion of the supporting frame structure. Each of a plurality of locking means positioned along the substantially horizontally disposed supporting member of the supporting frame structure, functions to secure selected ironing tables against rotation. Either selected ones or all of these locking members may be spring biased. Furthermore, the locking means may further function to lock the working surfaces either in the use position or in the storage position. Otherwise, a separate fixing device can be utilized.

The major ironing table associated with the ironing board of the present invention is substantially of rectangular shape with a curved end portion which end portion is designed to accommodate a certain portion of selected garments. The major ironing table has a triangular transverse cross-section defining two non-parallel working surfaces including a flat working surface and a profiled working surface which surfaces are designed to accommodate certain portions of selected garments, e.g., the yoke of a gentleman's shirt. The major ironing table also includes one or more notches to aid in moving longitudinally along and in rotating about the supporting member of the supporting frame structure. The minor ironing table associated with the ironing board of the present invention is substantially of triangular shape and may be of curved arcuate shape which shape generally is triangular, with the apex of the triangle being rounded, and has a substantially rectangular transverse cross-section defining two parallel working surfaces.

The ironing board of the present invention includes a supporting frame structure having a base portion including a first substantially horizontally disposed member, having a second substantially horizontally disposed member which member functions as the supporting member for the ironing tables, and having a substantially vertically disposed central supporting member joined at its proximal end to the first substantially horizontally disposed member and at its distal end to the second substantially horizontally disposed member. The first member carries at least a first cross foot and preferably a second cross foot, each cross foot being movably secured to the frame member by appropriate securement means. A selected portion of the second horizontally disposed supporting member may be elevated upwardly as much as 10° from a horizontal plane of reference, and preferably is titled upwardly at 2° from a horizontal plane of reference which elevation aids in engaging the locking means positioned along that selected portion of the second horizontal member. Lastly, the central supporting member of the supporting frame structure can be an adjustable, telescoping member used to position the height of the ironing tables and thus the working surfaces of the ironing board.

One object of the present invention is to provide an adjustable ironing table having plural ironing tables each separately pivotal about a respective selected portion of the supporting frame with at least one table including at least one and preferably two working surfaces.

Another object of the present invention is to provide an adjustable ironing board having plural adjustable and distinct ironing tables carried by a supporting frame and pivotable to a vertical position for compact storage of the ironing board, and to provide an adjustable ironing table having one or more stabilizing cross feet movably secured to the supporting frame and movable to a non-deployed position for compact storage of the ironing board.

A further object of the invention is to provide an ironing board having a plurality of working surfaces of which at least a first working surface is located on a first ironing table and at least a second working surface is located on a second ironing table which second ironing table is capable of being manipulated separately from the first ironing table.

Another object of the present invention is to provide an adjustable ironing board having at least one ironinq table bearing two working surfaces each of the two working surfaces having a different profile.

A further object of this invention is to provide an ironing board having a major ironing table including two working surfaces each surface having a different profile wherein each profile complements the construction of certain garments or articles of clothing, and aids in the ironing process utilized for that certain garment or article of clothing. In addition, a further object of this invention is to provide an ironing board having at least two profiled edge portions wherein each edge portion complements the construction of certain garments or articles of clothing, and aids in the ironing process utilized for that certain garment or article of clothing. Moreover, it is the further object of this invention that one of the profiled edge portions is positioned on the major ironing table and is utilized in conjunction with one and preferably two working surfaces carried by the major ironing table.

A further object of the invention is to provide an ironing board employing an inclined portion of the supporting frame member which frame member supports an ironing table and, wherein the inclined portion is elevated upwardly as much as substantially 10° from a horizontal plane of references and preferably is tilted upwardly at 2° from a horizontal plane of reference. The object of this incline is to facilitate the return to mating engagement of various securing means which means operate to secure certain respective ironing tables against rotation and in a predetermined position relative to the frame.

A further object of the invention is to provide an ironing board with a height adjustment means incorporated within a portion of the supporting frame.

A further object of the invention is to provide an ironing board having an ironing table wherein a portion of the longitudinal edge portion is of a one piece, angular construction.

BRIEF DESCRIPTION OF THE DRAWINGS

FIG. 4 is a transverse cross-sectional view of the major ironing table along line IV—IV in FIG. 2 showing a profiled working surface as well as a flat working surface.

FIG. 5 is an end view of the ironing board showing the parallel working surfaces of the minor ironing table.

FIG. 6 is a transverse cross-sectional view of one embodiment of a longitudinal edge portion of the major ironing table of the present invention.

DETAILED DESCRIPTION OF THE PREFERRED EMBODIMENT

Figure 1:
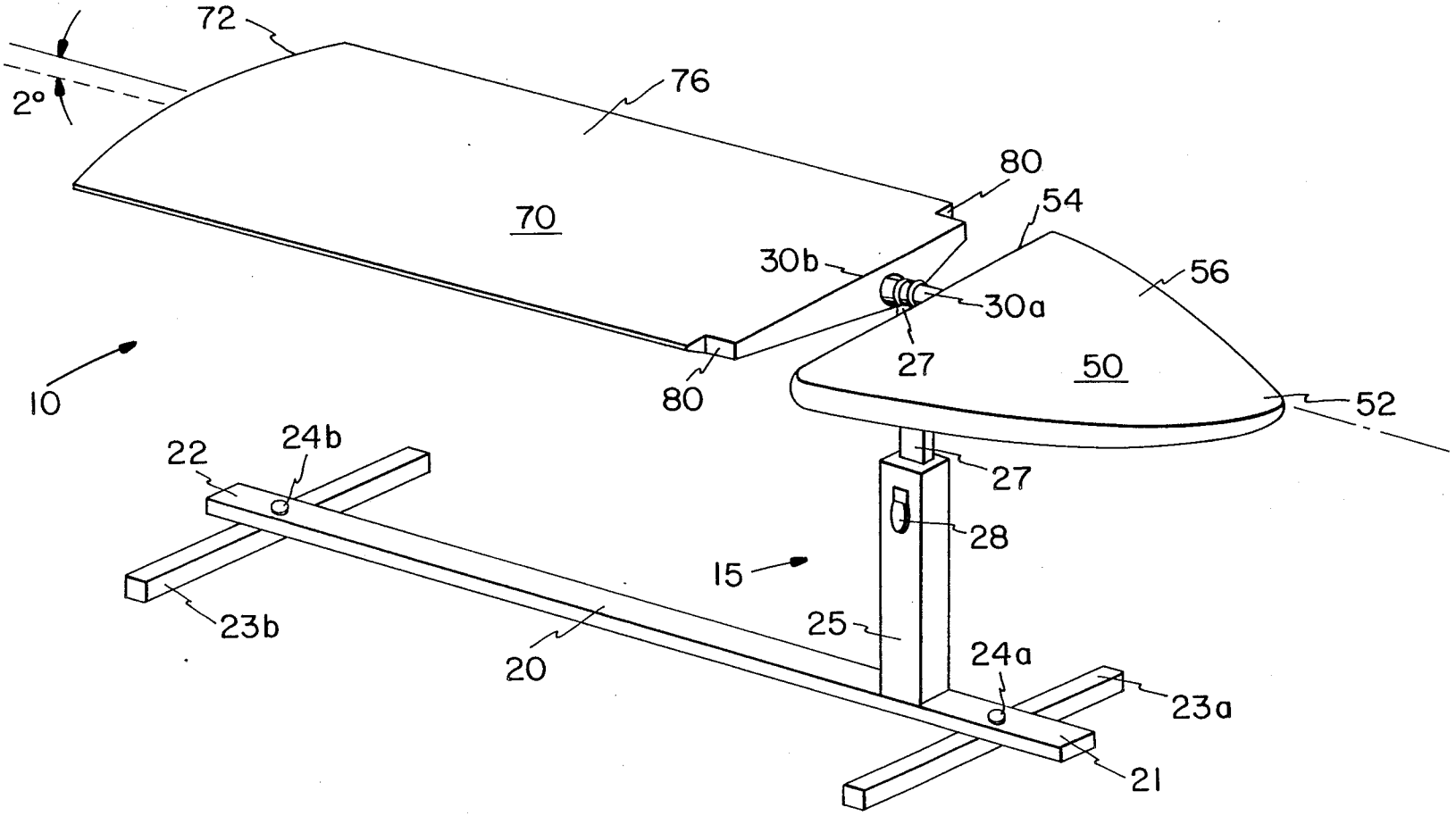
FIG. 1 is a view in perspective of an ironing board according to the present invention, with the ironing board shown in its use position.
Figure 2:
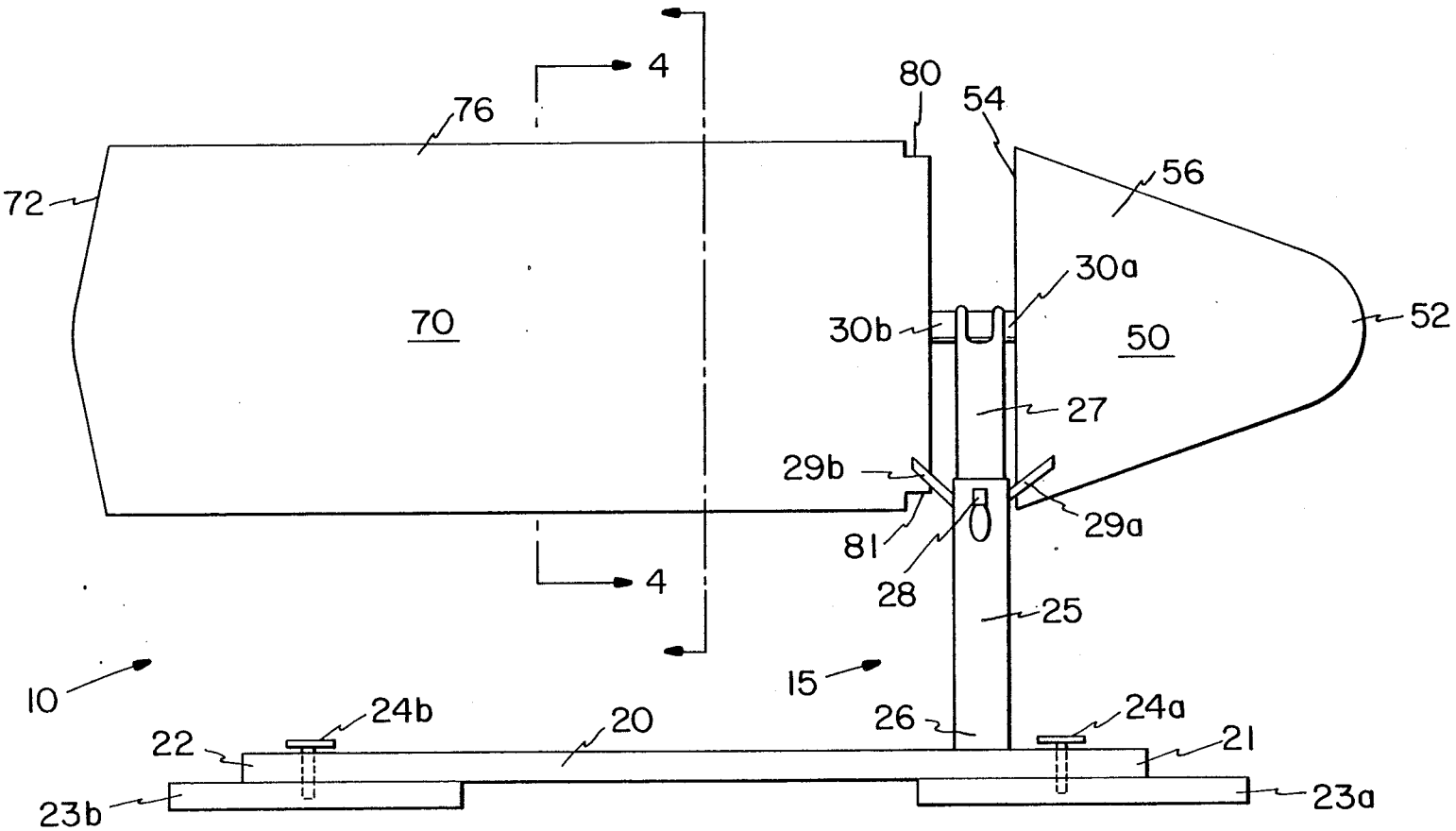
FIG. 2 is a side view of the ironing board, with the ironing board shown in its storage position.
Figure 3:
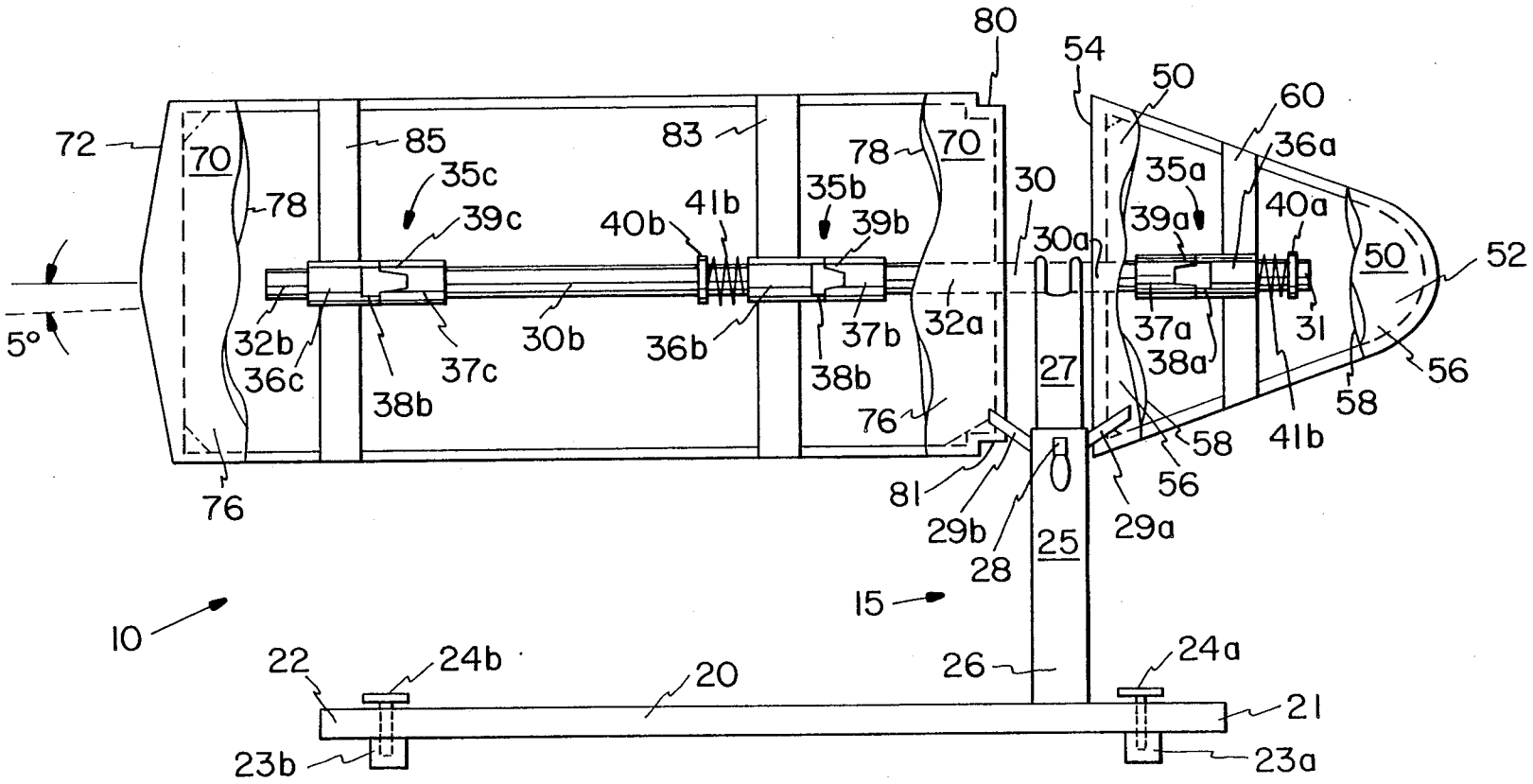
FIG. 3 is a side view of the ironing board shown in its storage position but with the cross feet deployed, taken partially in section to show the locking mechanism.

The ironing board of the present invention, denoted generally by 10, consists of a supporting frame 15 having a first substantially horizontally disposed base member 20, a substantially vertically disposed central supporting member 25 joined at its proximal end 26 to a proximal end portion 21 of member 20, and a second substantially horizontally disposed member 30 fixedly secured to the distal end 27 of horizontally disposed member 25 and radiating outwardly therefrom. Member 30 may be comprised of a first portion **30*a* and a second portion 30*b* each of which radiates outwardly in opposite directions from distal end portion 27 of central supporting member 25. Base member 20 carries at least a first cross foot 23*a* movably secured to proximal end portion 21 of frame member 20 by securement means 24*a*, for example, a securement means having a threaded portion such as a screw means. In addition, base member 20 preferably carries a second cross foot 23*b* movably secured to distal end portion 22 of frame member 20 by securement means 24*b*, for example, a securement means having a threaded portion such as a screw means. Securement means 24*a* and 24*b* allow each of respective cross feet 23*a* and 23*b* to be deployed at a right angle to frame member 20**, thereby providing a stable base structure.

The second substantially horizontal member 30 bears a plurality of locking members, for example, members **35*a*, 35*b* and 35*c*, selectively placed along member 30, and otherwise supports a plurality of ironing tables each table contributing to a disjointed ironing surface wherein the plurality of ironing tables includes, for example, two separate ironing tables, such as first or minor ironing table 50 and second or major ironing table 70**.

Ironing table 50 is the smaller of two separate ironing tables which tables comprise the disjointed ironing surface or working surface of the ironing board. Ironing table 50 is substantially a triangular member having a rounded apex portion 52 and a flat base portion 54. Ironing table 50 has at least one and preferably two working surfaces such as those denoted 56 and 58 which working surfaces are substantially flat and are substantially parallel one with the other. These working surfaces may be supplied with a suitable covering including a heat resistant covering. Ironing table 50 is connected by a cross brace 60 fixedly secured to a first part **36*a* of locking mechanism 35*a*. First part 36*a* is movably secured to rod 30 and cooperates with mating second part 37*a* which second part 37*a* is fixedly secured to rod 30. First and second mating parts 36*a* and 37*a* utilize cooperating fixing means 38*a* and 39*a*, respectively, to position the working surface portions 56 and 58 of ironing table 50 in a substantially horizontal position, that is, a position for use by a worker. The board may be rotated 90° from the horizontal position, and positioned in a substantially vertical position for storage; a holding means such as 29*a* can be used to secure the board in the vertical position, that is, a position for storage of the ironing board. As an alternative, each securement device may include additional positioning means to position the working surface portions 56 and 58 of the ironing table 50 either in a substantially horizontal position or in a substantially vertical position. A stop means 40*a*, such as an annular collar, is affixed adjacent the distal end portion 31 of horizontal rod 30 and acts to retain a spring means 41*a* positioned between the stop means 40*a* and first mating part 36*a*. When pressure is applied in a horizontal or sideways fashion, such as by hand, to base 54 of ironing table 50, ironing table 50 through first mating part 36*a* moves longitudinally along rod 30 compressing spring means 41*a* and disengaging cooperating fixing means 38*a* and 39*a*. When fixing means 38*a* and 39*a*** no longer are in mating engagement, ironing table 50 through first mating part 36*a* can be rotated about portion 30*a* of rod 30 to a predetermined position, and then released so that spring means 41*a* can expand to return first mating part 36*a* to mating engagement with second mating part 37*a* and thereby lock member 50 into position and against rotational movement about rod 30.

Ironing table 70 is the larger of two separate ironing tables which tables comprise the disjointed ironing surface or working surfaces of the ironing board. Ironing table 70 is a substantially rectangular member having a slightly curved outwardly extending end portion 72 and a flat base portion 74. Ironing table 70 has at least one and preferably two major working surfaces such as those denoted 76 and 78. These surfaces may be supplied with a suitable covering such as a heat resistant covering. Ironing table 70 is operatively connected to rod portion 30*b* of rod 30 by a series of cross braces, for example, cross braces 83 and 85. Specifically, cross braces 83 and 85 are fixedly secured respectively to first parts 36*b* and 36*c* of respective locking mechanisms 35*b* and 35*c*. Each of locking mechanisms 35*b* and 35*c* operate in a manner similar to locking mechanism 35*a*. First parts 36*b* and 36*c* are movably secured to portion 30*b* of rod 30 and cooperate with respective mating second parts 37*b* and 37*c*, which second parts are fixedly secured to portion 30*b* of rod 30. First and second mating parts 36*b* an 37*b* utilize cooperating fixing means 38*b* and 39*b*, respectively, to position the working surface portions 76 and 78 of ironing table 70 in a substantially horizontal position, that is, a position for use by a worker. The board may be rotated 90° from the horizontal position and positioned in a substantially vertical position for storage; a holding means such as 29*b* can be used to secure the board in the vertical position, that is, a position for storage of the ironing board. As an alternative, each securement device may include additional positioning means to position the working surface portions 56 and 58 of ironing table 70 in a substantially horizontal position, or in a substantially vertical position. Likewise, locking mechanism 35*c* cooperates with locking mechanism 35*b* to fixedly secure ironing table 70 in a predetermined position. Each of first and second mating parts 36*c* and 37*c* utilize cooperating fixing means 38*c* and 39*c*, respectively, to position the major working surface portions 76 and 78 of the ironing table 70 either in a substantially horizontal position or in a substantially vertical position, the former position being a position for use by a worker and the latter position being a position for storage of the ironing board.

Locking mechanism 35*b*, specifically first part 36*b*, is spring biased in the same manner as locking mechanism 35*a*. A stop means 40*b*, such as an annular collar, is affixed to rod 30 and acts to retain a spring means 41*b* positioned between the stop means 40*b* and first mating part 36*b*. When pressure is applied in a horizontal or sideways fashion, such as by hand engagement in one of notches 80 or 81 or, in the alternative, to base 74 of substantially rectangular ironing table 70, ironing table 70 through first mating parts 36*b* and 36*c* moves longitudinally along rod 30 compressing spring means 41*b* and disengaging cooperating fixing means 38*b* and 39*c* from mating engagement with cooperating fixing means 38*c* and 39*c*, for example. When fixing means 38*b* and 39*b*, as well as fixing means 38*c* and 39*c*, are no longer in mating engagement, ironing table 70 through first mating parts 36*b* and 36*c*, for example, can be rotated about rod 30 to a predetermined position, and then released so that spring means 41*b* can expand to return both first mating part 36*b* and first mating part 36*c* to mating engagement with respective second mating part 37*b* and second mating part 37*c* and thereby lock ironing table 70 into position and against rotational movement about rod 30. Additional spring means (not shown in the drawing) can be incorporated in additional locking means, such as locking means 35*c*, if necessary to achieve adequate sliding movement of mating parts along rod 30. In addition, to help facilitate the return of sliding first mating parts 36*b* and 36*c*, for example, for engagement with respective fixed second mating parts 37*b* and 37*c*, portion 30*b* of rod 30 extending from distal end 27 of central support 25 to distal end 32*b* may be positioned at an angle of inclination not to exceed 10° and preferably at an angle of inclination of 2° so that distal end 32*b* is elevated with respect to proximal end 32*a* of rod 30. At such an angle, e.g., 2° , less effort by the operator is needed to return ironing table 70 to a non-rotating position. In one embodiment, the angular displacement of that portion of rod 30 positioned between distal end 27 of central support 25 and distal end 32*b* of portion 30*b* of rod 30, is such that portion 30*b* will not be in co-axial alignment with portion 30*a* of rod 30 positioned between distal end 27 of central support 25 and distal end 31 of rod 30. In another embodiment portion 30*b* is included through elevation of distal end portion 22 of base member 20 to provide the plane of reference, that is, to elevate distal end 30*b* above proximal end 30*a*.

The working surfaces 76 and 78 of ironing table 70 are not parallel, as shown in FIG. 4. Surface 76 is substantially flat while surface 78 is profiled with a ridge portion 78*c* running longitudinally along the central portion of surface 78 thereby defining angularly displaced, non-parallel, non-coplanar portions 78*a* and 78*b*. When a garment such as a gentleman's shirt is slipped over the end 72 of ironing table 70, the back of the shirt will lie relatively flat against surface 76 while the front portions of the shirt will lie against portions 78*a* and 78*b* of ironing table 70. A gentleman's shirt may be buttoned for ease of placement on ironing table 70, in which case the front row of buttons will be arranged substantially along central portion 78*c* when the shirt is positioned on ironing table 70. In addition, end portion 72 of ironing table 70 is profiled and bears a curved portion which, for example, accommodates the yoke or shoulder portions and certain of the seams of a gentleman's shirt.

Each of the longitudinal edge portions of ironing table 70 preferably is formed, for example, by selectively folding a piece of sheet metal or, for example, by extruding an appropriate plastics material; the resulting piece is a member having a general exterior shape as shown in FIG. 6. This shape adds strength and rigidity to ironing table 70, and employs fewer fabrication steps and less material during construction of ironing table 70 than would be used for multipiece edge portions. Major ironing table 70 includes a longitudinal edge portion 77 used to join working surface 76 and working surface 78*a*, for example. One embodiment of edge portion 77 is shown in FIG. 6 and is designated 77'. Edge portion 77' includes a first planar portion 77*a* having a tab portion 77*d*, and includes a second planar portion 77*b* having a flange portion 77*e*. First planar portion 77*a* and second planar portion 77*b* intersect to form an angled portion 77*c* extending along a point of intersection of said first and said second planar portions. Flange portion 77*e* extends toward first planar portion 77*a*. Central portion 77*f* may be open, as shown in FIG. 6, or may be closed depending upon choice of material and construction technique.

Holding means 29a and 29b may each comprise a pair of parallel, rod-like elements secured, for example, for pivotal movement on central support 15. For storage of the ironing board 10, each of ironing tables 50 and 70, can be rotated to a vertical position and the appropriate holding means moved into a position to secure the respective ironing table in a substantially vertical position for storage.

Lastly, horizontally disposed member 25 may comprise telescoping members movable one relative to another so that the height of the working surface can be adjusted. An appropriate securement means, such as a lever actuated friction securement means, among other securement means, can be utilized as height adjustment means 28.

What is claimed is:

1. A rotatably adjustable ironing board comprising:

a supporting frame structure including a base structure, a substantially horizontally disposed supporting member, and a generally vertically disposed, adjustable central support joined at its proximal end to said base member and joined at its distal end to said substantially horizontally disposed supporting member;

a first ironing table supported by a first portion of said substantially horizontally disposed supporting member, said first portion of said substantially horizontally disposed supporting member being positioned generally along a longitudinal axis of said first ironing table, said first ironing table, including first means for rotation of said first ironing table about said first portion of said substantially horizontally disposed supporting member;

a second ironing table supported by a second portion of said substantially horizontally disposed supporting member, said second portion of said substantially horizontally disposed supporting member being positioned generally along a longitudinal axis of said second ironing table, said second ironing table, including second means for rotation of said second ironing table about said second portion of said substantially horizontally disposed supporting member;

a first locking mechanism operatively connected both to said first table and to said first portion for locking said first table against rotation about said first portion; and a second locking means operatively connected both to said second table and to said second portion for locking said second table against rotation about said second portion.

2. The pivotally adjustable ironing board of claim 1 wherein said base structure comprises a substantially horizontally disposed elongated base member including at least a first cross foot movably secured by first securement means to a first end portion of said elongated base member, said first cross foot being capable of placement in a position for storage and alternatively in a position of deployment.

3. The pivotally adjustable ironing board of claim 2 wherein said elongated base member includes a second cross foot movably secured by a second securement means to a second end portion of said elongated base member, said second cross foot being capable of placement in a position for storage and alternatively in a position of deployment.

4. The pivotally adjustable ironing board of claim 3 wherein said securement means includes a threaded portion.

5. The pivotally adjustable ironing board of claim 1 wherein said first ironing table is generally of triangular shape along its longitudinal axis and is generally of rectangular shape in transverse cross-section.

6. The pivotally adjustable ironing board of claim 1 wherein said second ironing table is generally of rectangular shape along its longitudinal axis and is generally of triangular shape in transverse cross-section.

7. The pivotally adjustable ironing board of claim 1 wherein said first ironing table is generally of triangular shape along its longitudinal axis and is generally of rectangular shape in transverse cross-section, and wherein said second ironing table is generally of rectangular shape along its longitudinal axis and generally of triangular shape in transverse cross-section.

8. The pivotally adjustable ironing board of claim 7 wherein said second ironing table includes an end portion having a slightly curved and outwardly extending edge portion, said edge portion being located at that end of said second ironing table opposite said central support.

9. The pivotally adjustable ironing board of claim 1 wherein said second ironing table includes a first handle means and a second handle means which first and second handle means are used to facilitate longitudinal movement of said second ironing table along said substantially horizontally disposed supporting member and are used to facilitate rotational movement about said substantially horizontally disposed supporting member.

10. The pivotally adjustable ironing board of claim 9 wherein said first handle means is a first notched portion of said second ironing table and wherein said second handle means is a second notched portion of said second ironing table; and wherein said first notched portion is positioned in a first corner of said second ironing table, said first corner being opposite said slightly curved edge portion and, upon full rotation of said second ironing table about said substantially horizontally disposed supporting member, said first notched portion passes adjacently to said central support, and wherein said second notched portion is positioned in a second corner of said second ironing table, said second corner being opposite said slightly curved edge portion and transversely opposed to said first notched portion, and, upon full rotation of said second ironing table about said substantially horizontally disposed supporting member, said second notched portion passes adjacently to said central support.

11. The pivotally adjustable ironing board of claim 1 wherein said second ironing table includes a longitudinal edge portion having a first planar portion and a second planar portion, said first and said second planar portions forming an angled portion extending along a point of intersection of said first and said second planar portions, said first planar portion having a tab portion and said second planar portion having a flange-like portion which extends toward said first planar portion.

12. The pivotally adjustable ironing board of claim 1 wherein said first locking mechanism includes a first part and a second part, said first part being movably secured to said first portion of said substantially horizontally disposed supporting member for longitudinal movement along and rotational movement about said first portion of said substantially horizontally disposed supporting member, said first part being fixedly secured to a cross brace, said cross brace being connected with and aiding in the support of said first ironing table; said second part being adapted for mating engagement with said first part and said second part being fixedly secured to said first portion of said substantially horizontally disposed supporting member to prohibit longitudinal movement along and rotational movement about said first portion of said substantially horizontally disposed supporting member; said first part and said second part having cooperating fixing means arranged for mating engagement, said cooperating fixing means, when engaged, prohibiting rotational movement of said first ironing table about said first portion of said substantially horizontally disposed supporting member, and, when disengaged, allowing rotational movement of said first ironing table about said first portion of said substantially horizontally disposed supporting member, said cooperating fixing means being positioned to allow said first ironing table to be selectively disposed generally horizontally in a position for use.

13. The pivotally adjustable ironing board of claim 12 wherein said first locking mechanism includes a spring means operatively connected with said first part to bias said first part into mating engagement with said second part.

14. The pivotally adjustable ironing board of claim 12 wherein said ironing board further comprises a holding means positioned to secure said first ironing table substantially in a generally vertical position for storage.

15. The pivotally adjustable ironing board of claim 14 wherein said holding means is included in said cooperating fixing means.

16. The pivotally adjustable ironing board of claim 1 wherein said second locking mechanism includes a first part and a second part, said first part being movably secured to a said portion of said substantially horizontally disposed supporting member for longitudinal movement along and rotational movement about said second portion of said substantially horizontally disposed supporting member, said first part being fixedly secured to a cross brace, said cross brace being integrally connected with and aiding in supporting said second ironing table; said second part being adapted for mating engagement with said first part and said second part being fixedly secured to said second portion of said substantially horizontally disposed supporting member to prohibit longitudinal movement along and rotational movement about said second portion of said substantially horizontally disposed supporting member, said first part and said second part having cooperating fixing means arranged for mating, engagement, said cooperating fixing means, when engaged, prohibiting rotational movement of said second ironing table about said second portion of said substantially horizontally disposed supporting member, and, when disengaged, allowing rotational movement of said second ironing table about said second portion of said substantially horizontally disposed supporting member, said cooperating fixing means being positioned to allow said second ironing table to be selectively disposed generally horizontally in a position for use.

17. The pivotally adjustable ironing board of claim 16 wherein said second locking mechanism includes a spring means operatively connected with said first part to bias said first part into mating engagement with said second part.

18. The pivotally adjustable ironing board of claim 16 wherein said ironing board further comprises a holding means positioned to secure said second ironing table substantially in a generally vertical position for storage.

19. The pivotally adjustable ironing board of claim 18 wherein said holding means is included in said cooperating fixing means.

20. The pivotally adjustable ironing board of claim 1 wherein said first locking mechanism includes a first part and a second part, said first part being movably secured to said first portion of said substantially horizontally disposed supporting member for longitudinal movement along and rotational movement about said first portion of said substantially horizontally disposed supporting member; said first part being fixedly secured to a first cross brace, said first cross brace being connected with and aiding in the support of said first ironing table; said second part being adapted for mating engagement with said first part, and said second part being fixedly secured to said first portion of said substantially horizontally disposed supporting member to prohibit longitudinal movement along and rotational movement about said first portion of said substantially horizontally disposed supporting member; said first part and said second part including, respectively, a first and a second cooperating fixing means arranged for mating engagement one with the other, said first and said second cooperating fixing means, when engaged, prohibiting rotational movement of said first ironing table about said first portion of said substantially horizontally disposed supporting member, and, when disengaged, allowing rotational movement of said first ironing table about said first portion of said substantially horizontally disposed supporting member, said first and said second cooperating fixing means being positioned to allow said first ironing table to be selectively disposed generally horizontally for use; said first locking mechanism including a first spring means operatively connected with said first part of said first locking mechanism to bias said first cooperating fixing means into mating engagement with said second cooperating fixing means; and wherein said second locking mechanism includes a third part and a fourth part, said third part being movably secured to said second portion of said substantially horizontally disposed supporting member for longitudinal movement along and rotational movement about said second portion of said substantially horizontally disposed supporting member; said third part being fixedly secured to a second cross brace, said second cross brace being connected with and aiding in the support of said second ironing table; said fourth part being adapted for mating engagement with said third part, and said fourth part being fixedly secured to said second portion of said substantially horizontally disposed supporting member to prohibit longitudinal movement along and rotational movement about said second portion of said substantially horizontally disposed supporting member; said third part and said fourth part including, respectively, a first and a second cooperating fixing means arranged for mating engagement one with the other, said third and said fourth cooperating fixing means, when engaged, prohibiting rotational movement of said second ironing table about said second portion of said substantially horizontally disposed supporting member, and, when disengaged, allowing rotational movement of said ironing table about said first portion of said substantially horizontally disposed supporting member, said third and said fourth cooperating fixing means being positioned to allow said second ironing table to be selectively disposed generally horizontally for use; said second locking mechanism including a second spring means operatively connected with said third part of said second locking mechanism to bias said third cooperating fixing means into mating engagement with said fourth cooperating fixing means.

21. The pivotally adjustable ironing board of claim 20 wherein said ironing board further comprises a first holding means positioned to secure said first ironing table against rotation and in a generally vertical position for storage, and further comprises a second holding means positioned to secure said second ironing table against rotation and in a generally vertical position for storage.

22. The pivotally adjustable ironing board of claim 21 wherein said first holding means is included in said first and said second cooperating fixing means carried respectively on said first part and said second part of said first locking mechanism, and said second holding means is included in said first and said second cooperating fixing means carried respectively on said third part and said fourth part of said second locking mechanism.

23. The pivotally adjustable ironing board of claim 20 wherein said second portion of said substantially horizontally disposed supporting member includes a proximal end portion joined with said central support and includes a distal end portion disposed radially outwardly from said central support, said second portion of said supporting member having an angle of inclination no greater than ten degrees with respect to a horizontal plane of reference, such that said distal end portion is elevated with respect to said proximal end portion.

24. The pivotally adjustable ironing board of claim 23 wherein said angle of inclination is two degrees with respect to said horizontal plane of reference.

25. The pivotally adjustable ironing board of claim 1 wherein said second portion of said substantially horizontally disposed supporting member includes a proximal end portion joined with said central support and includes a distal end portion disposed radially outwardly from said central support, said second portion of said supporting member having an angle of inclination no greater than ten degrees with respect to a horizontal plane of reference, such that said distal end portion is elevated with respect to said proximal end portion.

26. The pivotally adjustable ironing board of claim 25 wherein said angle of inclination is two degrees with respect to said horizontal plane of reference.

27. The pivotally adjustable ironing board of claim 1 wherein said base structure comprises a substantially horizontally disposed elongated base member including at least a first cross foot movably secured by first securement means to a first end portion of said elongated base member, said first cross foot being capable of placement in a position for storage and alternatively in a position of deployment;

said first ironing table being generally of triangular shape along its longitudinal axis and being generally of rectangular shape in transverse cross-section;

said second ironing table being generally of rectangular shape along its longitudinal axis and being generally of triangular shape in transverse cross-section;

said second ironing table including an end portion having a slightly curved and outwardly extending edge portion, said edge portion being located at that end of said second ironing table opposite said central support;

said second ironing table including a first handle means and a second handle means which first and second handle means are used to facilitate longitudinal movement of said second ironing table along said substantially horizontally disposed supporting member and are used to facilitate rotational movement about said substantially horizontally disposed supporting member;

said first locking mechanism including a first part and a second part, said first part being movably secured to said first portion of said substantially horizontally disposed supporting member for longitudinal movement along and rotational movement about said first portion of said substantially horizontally disposed supporting member; said first part being fixedly secured to a first cross brace, said first cross brace being integrally connected with and aiding in the support of said first ironing table; said second part being adapted for mating engagement with said first part and said second part being fixedly secured to said first portion of said substantially horizontally disposed supporting member to prohibit longitudinal movement along and rotational movement about said first portion of said substantially horizontally disposed supporting member; said first part and said second part including, respectively, a first and a second cooperating fixing means arranged for mating engagement one with the other, said first and said second cooperating fixing means, when engaged, prohibiting rotational movement of said first ironing table about said first portion of said substantially horizontally disposed supporting member, and, when disengaged, allowing rotational movement of said first ironing table about said first portion of said substantially horizontally disposed supporting member, said first and said second cooperating fixing means being positioned to allow said first ironing table to be selectively disposed generally vertically for storage and to be selectively disposed generally horizontally for use;

said second locking mechanism including a third part and a fourth part, said third part being movably secured to said second portion of said substantially horizontally disposed supporting member for longitudinal movement along and rotational movement about said second portion of said substantially horizontally disposed supporting member; said third part being fixedly secured to a second cross brace, said second cross brace being integrally connected with and aiding in the support of said second ironing table; said fourth part being adapted for mating engagement with said third part and said fourth part being fixedly secured to said second portion of said substantially horizontally disposed supporting member to prohibit longitudinal movement along and rotational movement about said second portion of said substantially horizontally disposed supporting member; said third part and said fourth part including, respectively, a first and a second cooperating fixing means arranged for mating engagement one with the other, said third and said fourth cooperating fixing means, when engaged, prohibiting rotational movement of said second ironing table about said second portion of said substantially horizontally disposed supporting member, and, when disengaged, allowing rotational movement of said second ironing table about said second portion of said substantially horizontally disposed supporting member, said third and said fourth cooperating fixing means being positioned to allow said second ironing table to be selectively disposed generally vertically for storage and to be disposed generally horizontally for use; and said second portion of said substantially horizontally disposed supporting member including a proximal end portion joined with said central support and including a distal end portion disposed radially outwardly from said central support, said second portion of said supporting member having an angle of inclination of five degrees with respect to a horizontal plane of reference, such that said distal end portion is elevated with respect to said proximal end portion.

* * * * *